US008861773B2

(12) United States Patent
Liang et al.

(10) Patent No.: US 8,861,773 B2
(45) Date of Patent: Oct. 14, 2014

(54) SPEAKER MODULE AND RELATED ELECTRONIC DEVICE

(71) Applicant: Wistron Corporation, New Taipei (TW)

(72) Inventors: Jyun-Shuo Liang, New Taipei (TW); Chu-Cheng Yang, New Taipei (TW); Ming-Lun Liu, New Taipei (TW); Yu-Sheng Lin, New Taipei (TW); Hung-Li Chen, New Taipei (TW)

(73) Assignee: Wistron Corporation, Hsichih, New Taipei (TW)

( * ) Notice: Subject to any disclaimer, the term of this patent is extended or adjusted under 35 U.S.C. 154(b) by 27 days.

(21) Appl. No.: 13/798,254

(22) Filed: Mar. 13, 2013

(65) Prior Publication Data

US 2014/0064549 A1 Mar. 6, 2014

(30) Foreign Application Priority Data

Sep. 6, 2012 (TW) ..... 101132555 A

(51) Int. Cl.
*H04R 1/32* (2006.01)
*H04R 5/02* (2006.01)

(52) U.S. Cl.
CPC ..... *H04R 1/323* (2013.01); *H04R 2201/025* (2013.01); *H04R 5/02* (2013.01)
USPC ..... 381/387; 381/388; 381/304

(58) Field of Classification Search
CPC ..... H04R 1/32; H04R 1/323; H04R 1/34; H04R 1/345; H04R 5/00; H04R 5/02; H04R 2201/025; H04R 25/40; H04R 25/402
USPC ..... 381/386–388, 395, 356, 300, 304–306, 381/333, 313, 312; 181/140, 141, 143, 150, 181/153; 248/394–396
See application file for complete search history.

(56) References Cited

U.S. PATENT DOCUMENTS

| | | | | | |
|---|---|---|---|---|---|
| 2,922,609 | A | * | 1/1960 | Collier | 248/179.1 |
| 4,292,679 | A | * | 9/1981 | Kondo et al. | 367/188 |
| 4,441,577 | A | * | 4/1984 | Kurihara | 181/147 |
| 4,553,630 | A | * | 11/1985 | Ando | 181/144 |
| 4,630,303 | A | * | 12/1986 | Tanno | 381/87 |
| 4,917,212 | A | * | 4/1990 | Iwaya | 181/141 |
| 5,133,428 | A | * | 7/1992 | Perrson | 181/153 |
| 6,052,275 | A | * | 4/2000 | Joseph | 361/679.23 |

(Continued)

FOREIGN PATENT DOCUMENTS

| | | | | | |
|---|---|---|---|---|---|
| JP | 62269597 | A | * | 11/1987 | H04R 1/32 |

*Primary Examiner* — Curtis Kuntz
*Assistant Examiner* — Joshua A Kaufman
(74) *Attorney, Agent, or Firm* — Winston Hsu; Scott Margo

(57) ABSTRACT

A speaker module is capable of adjusting an outputting direction of an audio signal. The speaker module includes a base, a supporter, a speaker and a lifting mechanism. The supporter is disposed on the base. The speaker includes a speaker unit and an arm. The speaker unit is suspended above the base for generating the audio signal. A first end of the arm is connected to a lateral side of the speaker unit, and a second end of the arm is movably disposed on the supporter. The lifting mechanism includes a first lifting component disposed on the speaker unit, a body disposed on the base, and a second lifting component disposed on the body. The second lifting component can adjust a height of the first lifting component, so as to rotate the speaker unit relative to the supporter.

15 Claims, 7 Drawing Sheets

(56) References Cited

U.S. PATENT DOCUMENTS

| | | | | |
|---|---|---|---|---|
| 6,356,640 | B1 * | 3/2002 | Lin | 381/182 |
| 7,883,065 | B2 * | 2/2011 | Nelson | 248/201 |
| 8,023,683 | B2 * | 9/2011 | Lin | 381/387 |
| 8,292,246 | B2 * | 10/2012 | Drumm et al. | 248/311.2 |
| 8,660,291 | B2 * | 2/2014 | Wang | 381/392 |
| 8,724,842 | B2 * | 5/2014 | Sumitani et al. | 381/387 |
| 2004/0135476 | A1 * | 7/2004 | Gillengerten | 312/8.16 |
| 2008/0199037 | A1 * | 8/2008 | Xu et al. | 381/387 |
| 2009/0285429 | A1 * | 11/2009 | Wang | 381/332 |
| 2013/0022229 | A1 * | 1/2013 | Sprinkle | 381/387 |

* cited by examiner

SPEAKER MODULE AND RELATED ELECTRONIC DEVICE

BACKGROUND OF THE INVENTION

1. Field of the Invention

The present invention relates to a speaker module and a related electronic device, and more particularly, to a speaker module capable of adjusting an outputting direction of a sound and a related electronic device.

2. Description of the Prior Art

A conventional consumer electronic device includes the high quality display and the built-in speaker module to provide preferred entertainment. For example, the conventional consumer electronic device can be a notebook computer or a liquid crystal television. The liquid crystal television trends to the thin structural appearance and has the speaker module generating high quality sound. The conventional speaker module is disposed on two sides of the screen of the liquid crystal television. The conventional speaker module is designed according to thin trend of the liquid crystal television, so that the conventional built-in speaker module can not adjust the outputting direction of sound, and sound filed of the conventional built-in speaker module is poor.

The conventional speaker modules of the notebook computer are disposed on two sides of the screen. A few notebook computers include the adjustable speaker module detachably disposed inside the casing of the notebook computers. The adjustable speaker module can be drawn out of the casing for adjusting a rotary angle of the speaker module. The preferred rotary angle of each speaker module can be adjusted to 60 degrees relative to the user. However, the casing of the notebook computer can not have artistic appearance due to the conventional detachable speaker module. Therefore, design of a speaker module capable of automatically adjusting an outputting direction of the sound and having preferred appearance is an important issue in the mechanical industry.

SUMMARY OF THE INVENTION

The present invention provides a speaker module capable of adjusting an outputting direction of a sound and a related electronic device for solving above drawbacks.

According to the claimed invention, a speaker module includes a base, a supporter, a speaker and a lifting mechanism. The supporter is disposed on the base. The speaker includes a speaker unit and an arm. The speaker unit is disposed above the base. A sound is generated by the speaker unit. A first end of the arm is connected to a lateral side of the speaker unit. A second end of the arm different from the first end is movably disposed on the supporter. The lift mechanism includes a first lifting component, a body and a second lifting component. The first lifting component is disposed on the speaker unit. The body is disposed on the base. The second lifting component is disposed on the body and adjacent to the first lifting component. The second lifting component adjusts a height of the first lifting component, so as to rotate the speaker unit relative to the supporter via the arm.

According to the claimed invention, the first lifting component and the second lifting component respectively are inclined structures. The body is slidably disposed on the base. The second lifting component slides relative to the first lifting component with a movement of the body, so as to adjust the height of the first lifting component.

According to the claimed invention, the lifting mechanism further includes a mechanical driver for sliding the second lifting component relative to the first lifting component. The mechanical driver includes a rack and a gear. The rack is disposed on the body. The gear is disposed on the base and engaged with the rack. The gear is revolved on a shaft to move the body relative to the base via the rack, so that the second lifting component slides relative to the first lifting component.

According to the claimed invention, the first lifting component and the second lifting component respectively are electromagnetic components. The second lifting component utilizes magnetic force to adjust the height of the first lifting component.

According to the claimed invention, the lifting mechanism further includes an electromagnetic driver for adjusting the height of the first lifting component relative to the second lifting component. The electromagnetic driver includes a magnetic element and an electromagnetic element. The magnetic element is disposed on the first lifting component. The electromagnetic element is disposed on the second lifting component. The magnetic force is generated between the magnetic element and the electromagnetic element by variation of magnetic flux.

According to the claimed invention, the speaker module further includes a resilient washer disposed on the supporter. The arm is movably disposed on the supporter via the resilient washer.

According to the claimed invention, the speaker module further includes two supporters, and the speaker further includes two arms respectively disposed on two opposite sides of the speaker unit. Each arm is movably disposed on the corresponding supporter. The lifting mechanism further includes two first lifting components and two second lifting components respectively disposed on two opposite sides of the speaker unit and the body. The lifting mechanism adjusts the height of each first lifting component relative to the corresponding second lifting component to vary a rotary angle of the speaker unit.

According to the claimed invention, the speaker module further includes a sensor and a controller. The sensor detects a position of an external object. The controller is electrically connected to the sensor and the lifting mechanism. The controller adjusts the height of the first lifting component according to detection of the sensor, so as to control a rotary angle of the speaker unit.

According to the claimed invention, an electronic device includes a casing and at least one speaker module. The casing includes an accommodating structure and a plank. At least one hole is formed on the plank. The plank covers the accommodating structure. The speaker module is disposed inside the accommodating structure. A sound outputted from the speaker module passes through the hole on the plank to be out of the accommodating structure. The speaker module includes a base, a supporter, a speaker and a lifting mechanism. The supporter is disposed on the base. The speaker includes a speaker unit and an arm. The speaker unit is disposed above the base. A sound is generated by the speaker unit. A first end of the arm is connected to a lateral side of the speaker unit. A second end of the arm different from the first end is movably disposed on the supporter. The lift mechanism includes a first lifting component, a body and a second lifting component. The first lifting component is disposed on the speaker unit. The body is disposed on the base. The second lifting component is disposed on the body and adjacent to the first lifting component. The second lifting component adjusts a height of the first lifting component, so as to rotate the speaker unit relative to the supporter via the arm.

According to the claimed invention, the electronic device includes two speaker modules respectively on two opposite sides of the casing. The controller rotates each speaker module at an angle pointing toward the external object according to the detection.

The speaker module of the present invention can adjust the rotary angle of the speaker unit. The present invention further can detect the position of the user, rotate the speaker modules toward the user according to the detection for preferred sound filed. Thus, the sound generated by the speaker modules can be combined with each other, to form the sound waves with huge amplitude, so as to simulate the stereo sound and to enhance effect of the low-frequency sound. The rotary speaker module is disposed inside the casing, so that the electronic device of the present invention can conform to the concise appearance. The lifting mechanism of the present invention not only has advantages of simple structure, easy operation and low manufacturing cost, but also has small volume. The small size lifting mechanism can be easily disposed inside the accommodating structure of the casing with the speaker, and the electronic device performs the concise appearance.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
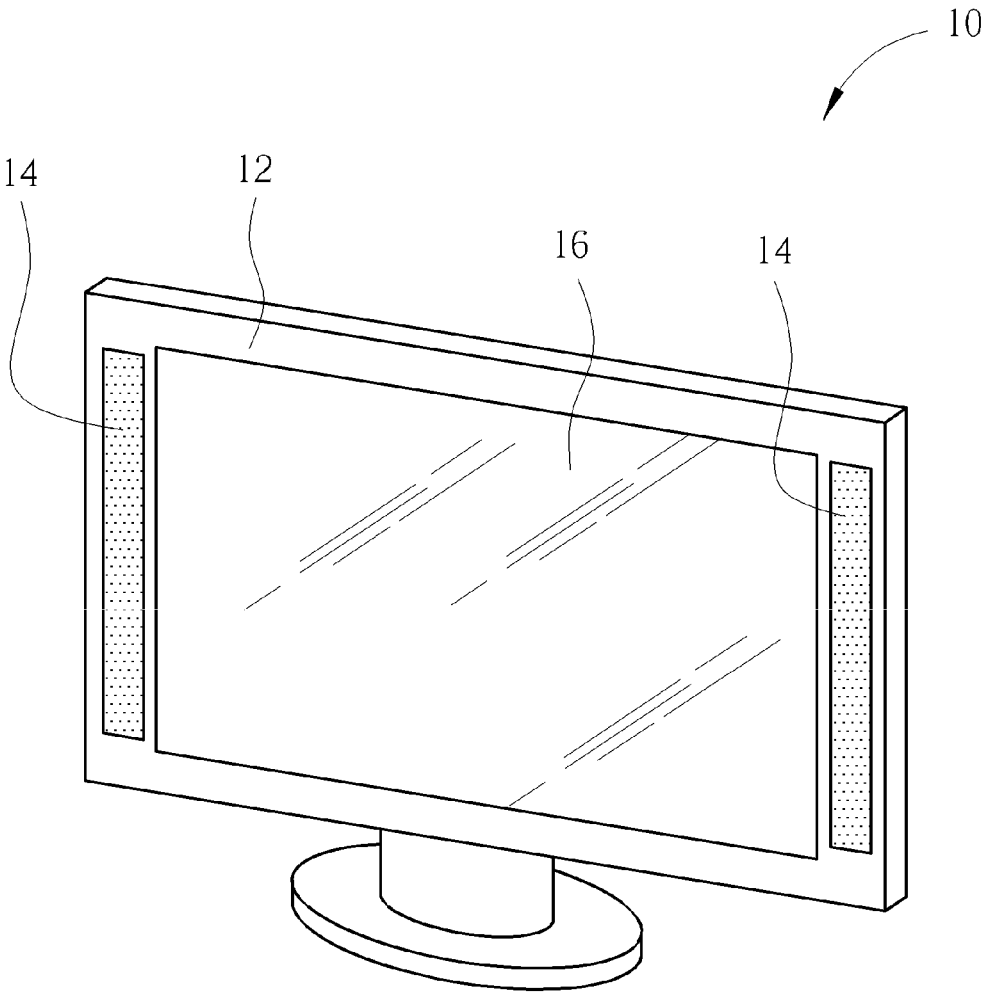
FIG. 1 is a diagram of an electronic device according to an embodiment of the invention.

Please refer to FIG. 1. FIG. 1 is a diagram of an electronic device 10 according to an embodiment of the invention. The electronic device 10 can be a liquid crystal television or a portable computer. The electronic device 10 includes a casing 12, at least one speaker module 14 and a liquid crystal display 16. The liquid crystal display 16 can be disposed on a center of the casing 12, and the speaker module 14 is electrically connected to the liquid crystal display 16 and is disposed inside the casing 12. The speaker module 14 can output a sound according to an image displayed on the liquid crystal display 16. Generally, the electronic device 10 can include two speaker modules 14 disposed on a left side and a right side of the liquid crystal display 16, or disposed on an upper side and a low side of the liquid crystal display 16, selectively. The two speaker modules 14 can provide preferred sound quality, such as stereo sound and low-frequency sound.

Figure 2:
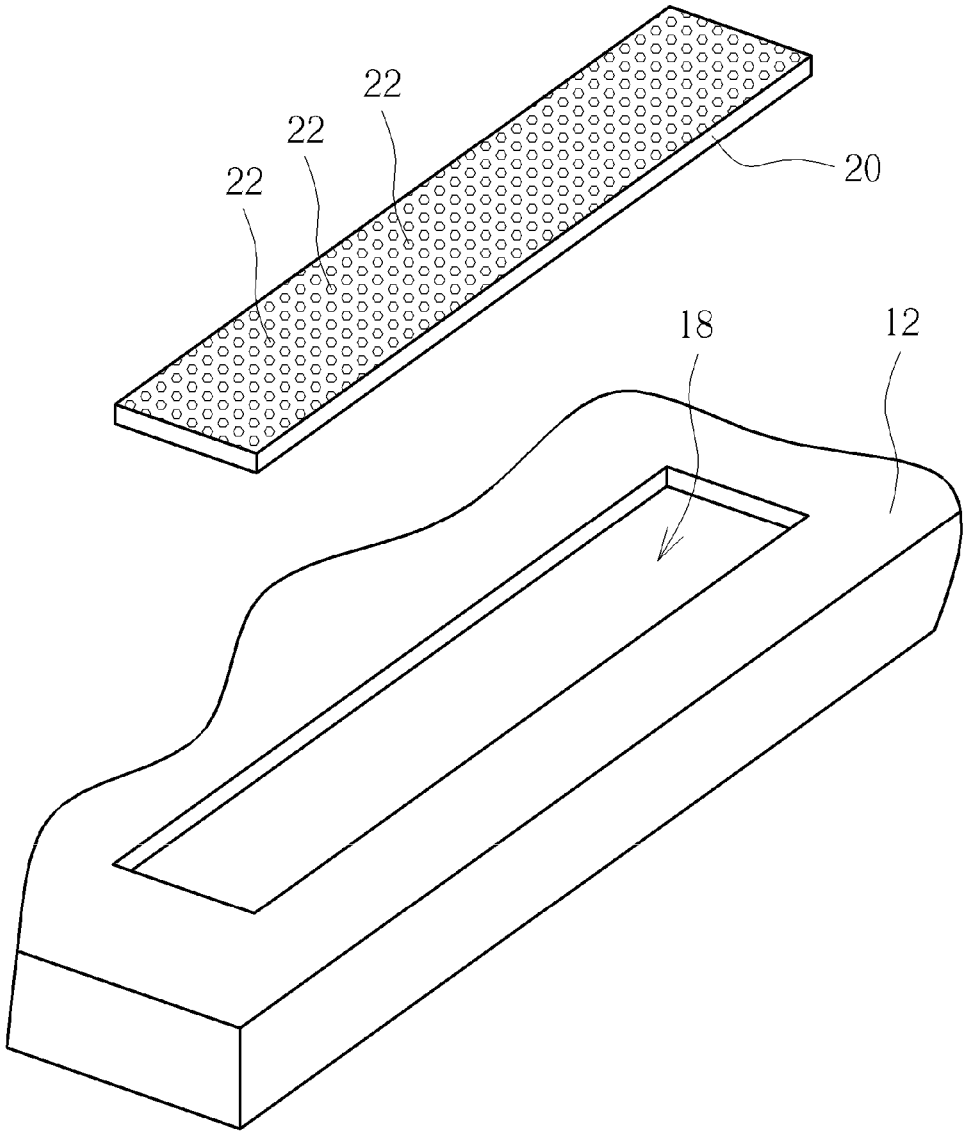
FIG. 2 is a diagram of a casing according to the embodiment of the invention.

Please refer to FIG. 2. FIG. 2 is a diagram of the casing 12 according to the embodiment of the invention. The casing 12 includes an accommodating structure 18 and a plank 20. The speaker module 14 is disposed inside the accommodating structure 18, which means the speaker module 14 disposed inside the casing 12 is invisible, so the electronic device 10 has concise appearance. The plank 20 can cover the accommodating structure 18 to prevent the speaker module 14 from separation. In addition, a plurality of holes 22 can be formed on a surface of the plank 20. The sound generated by the speaker module 14 can pass through the holes 22 to be out of the accommodating structure 18. Then the user can hear clear sound.

Figure 3:
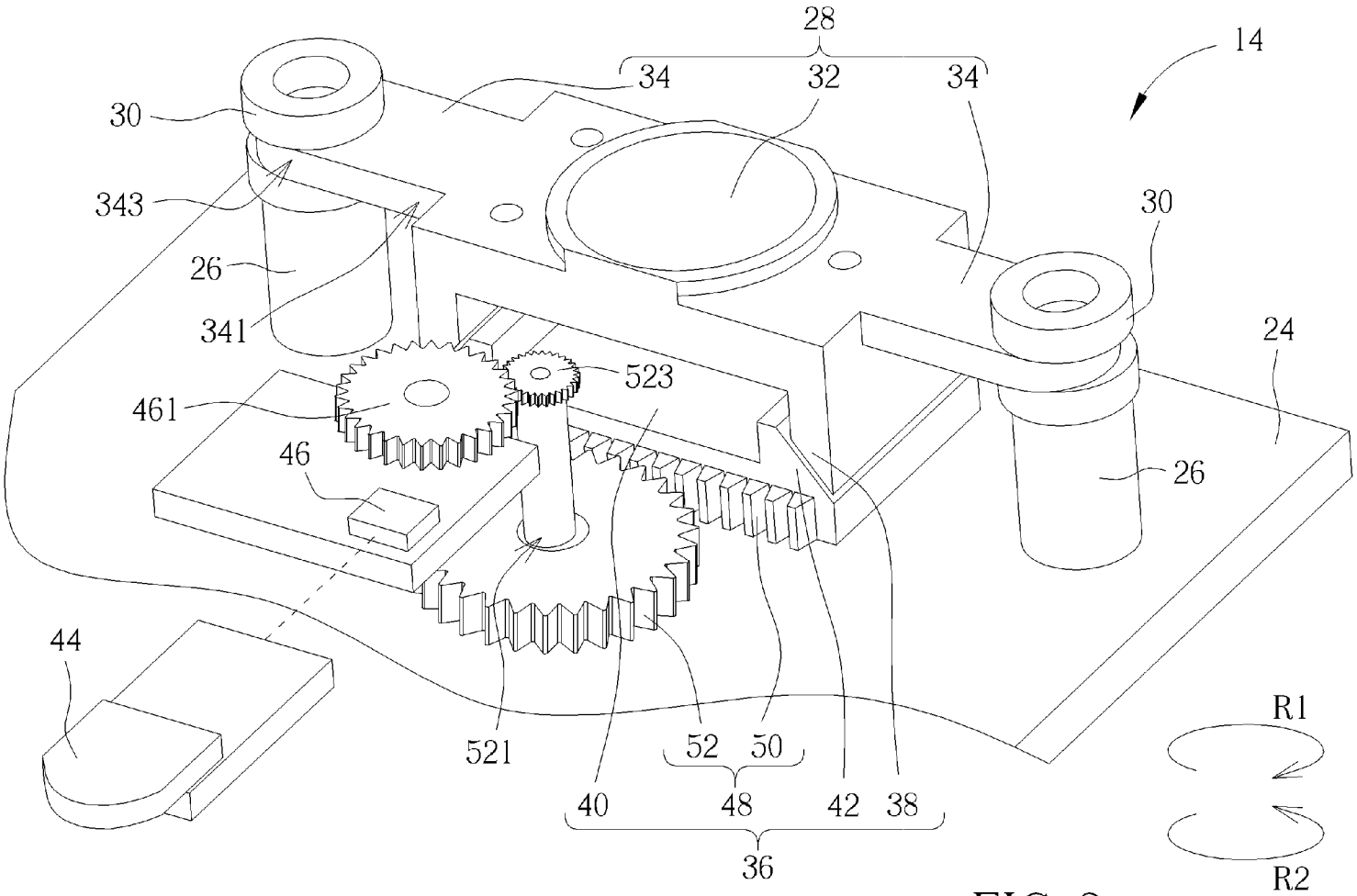
FIG. 3 is a diagram of a speaker module according to the first embodiment of the invention.

Please refer to FIG. 3. FIG. 3 is a diagram of the speaker module 14 according to the first embodiment of the invention. The speaker module 14 includes a base 24, two supporters 26, a speaker 28 and two resilient washers 30. The supporter 26 is disposed on the base 24, and the speaker 28 is movably disposed on the supporter 26, so that the speaker 28 can rotate relative to the base 24 for adjusting an outputting direction of the sound. The present invention disposes the resilient washer 30 between the supporter 26 and the speaker 28. The resilient washer 30 can hold the speaker 28 on the supporter 26, and further provide a moveable allowance that the speaker 28 can rotate relative to the supporter 26. An amount of the resilient washer 30 corresponds to an amount of the supporter 26. Each resilient washer 30 is disposed on the corresponding supporter 26, and the speaker 28 is connected to the supporters 26 via the resilient washers 30. Therefore, the speaker 28 can utilize resilient deformation of the resilient washer 30 to shake between the supporters 26, so as to adjust the outputting direction of the sound.

As shown in FIG. 3, the speaker 28 preferably includes a speaker unit 32 and two arms 34. The arms 34 are respectively disposed on two opposite sides of the speaker unit 32. A first side 341 of each arm 34 is connected to the side of the speaker unit 32, and a second side 343 of each arm 34 different from the first side 341 is movably disposed on the supporter 26 via the resilient washer 30. The speaker unit 32 can be suspended above the base 24. The speaker module 14 further includes a lifting mechanism 36 disposed under the speaker 28. The lifting mechanism 35 can move the speaker 28 to adjust the outputting direction of the sound.

The lifting mechanism 36 includes two first lifting components 38, a body 40 and two second lifting components 42. The first lifting components 38 are respectively connected to two opposite sides of the speaker unit 32. The second lifting components 42 are respectively connected to two opposite sides of the body 40 and are adjacent to the corresponding first lifting component 38. The body 40 is disposed on the base 24. The body 40 and the speaker unit 32 are separated units. The lifting mechanism 36 utilizes a relative movement between the first lifting component 38 and the second lifting component 42 to adjust a height of the first lifting component 38, so as to rotate the speaker unit 32 relative to the supporter 26 via the arms 34. A rotary angle of the speaker unit 32 can correspond to a length of the arm 34. For example, the length of the arm 34 is longer, the rotary angle of the speaker unit 32 is smaller; the length of the arm 34 is shorter, the rotary angle of the speaker unit 32 is larger.

Besides, the speaker module 14 can further include a sensor 44 and a controller 46. The sensor 44 can detect a position of an external object. For example, the external object can be the user, and the sensor 44 can detect a distance and a position of the user relative to the electronic device 10. The sensor 44 can be an ultrasonic sensor, a temperature sensor, an optical sensor, an infrared sensor, a sound sensor or an image sensor. Sensors capable of detecting an angle variation and a movement of the external object belong to a scope of the present invention, and detailed description is omitted herein for simplicity. The sensor 44 can be disposed on the casing 12 and placed on an upper edge of the frame whereon the liquid crystal display 16 is disposed.

The controller 46 can be electrically connected to the sensor 44 by wireless connection, and the controller 46 can be connected to the lifting mechanism 36 via a gear 52 and a shaft 521 for driving function. Connection between the sensor 44 and the controller 46 can be set by a plurality of electronic components, such as a circuit board, a connector and a switch. Circuit disposition is not limited to the above-mentioned embodiment, and depends on design demand. As the sensor 44 detects the movement of the user, the controller 46 can rotate a gear 461 according to detection of the sensor 44. The gear 461 disposed on the controller 46 is engaged with a small gear 523 on the shaft 521, so that the small gear 523 rotates with the gear 461 to simultaneously drive the shaft 521, and the gear 52 rotates by the shaft 521. Because the gear 52 is engaged with the rack 50, the height of the first lifting component 38 can be adjusted by rotation of the shaft 521 and the gear 52, and the rotary angle of the speaker unit 32 can be varied accordingly. Therefore, the outputting direction of the sound of the speaker module 14 can point toward the user, so as to provide the high quality sound for entertainment.

It should be mentioned that the electronic device 10 of the present invention can utilize one sensor 44 to control the outputting directions of the sound generated by the speaker modules 14. The outputting direction of the sound corresponds to the rotary angle of the speaker unit 32 relative to the base 24. When the sensor 44 detects the position and the distance of the user (the external object), the detection is transmitted from the sensor 44 to the controller 46. The controller 46 can analyze the relative position between the user and the speaker module 14, and respectively rotate the speaker modules 14 to 30 degrees relative to the user, so as to simulate the stereo sound, and further to enhance performance of the low-frequency sound. The rotary angle of the speaker module 14 is not limited to the above-mentioned embodiment, and depends on actual demand.

For driving the relative movement between the first lifting component 38 and the second lifting component 42, the speaker module 14 of the present invention can utilize mechanical skill or electromagnetic skill to adjust the height of the first lifting component 38 relative to the second lifting component 42. A mechanical mechanism is disclosed in the first embodiment. The lifting mechanism 36 can further include a mechanical driver 48 disposed between the lifting components. The mechanical driver 48 can include the rack 50 and the gear 52. The rack 50 can be disposed on the body 40. The gear 52 can be disposed on the base 24 and is engaged with the rack 50.

As shown in FIG. 3, the first lifting component 38 and the second lifting component 42 can respectively be inclined structures, and the body 40 is slidably disposed on the base 24. For adjusting the rotary angle of the speaker unit 32, the controller 46 can revolve the gear 52 on the shaft 521, and the gear 52 can slide the body 40 relative to the base 24 via the rack 50. As the body 40 moves, the second lifting component 42 can slide relative to the first lifting component 38, which means that the second lifting component 42 pushes the first lifting component 38 upwardly, or the first lifting component 38 is descended when the second lifting component 42 moves away from the first lifting component 38. Thus, the height of the first lifting component 38 relative to the second lifting component 42 can be adjusted to vary the rotary angle of the speaker unit 32.

Figure 4:
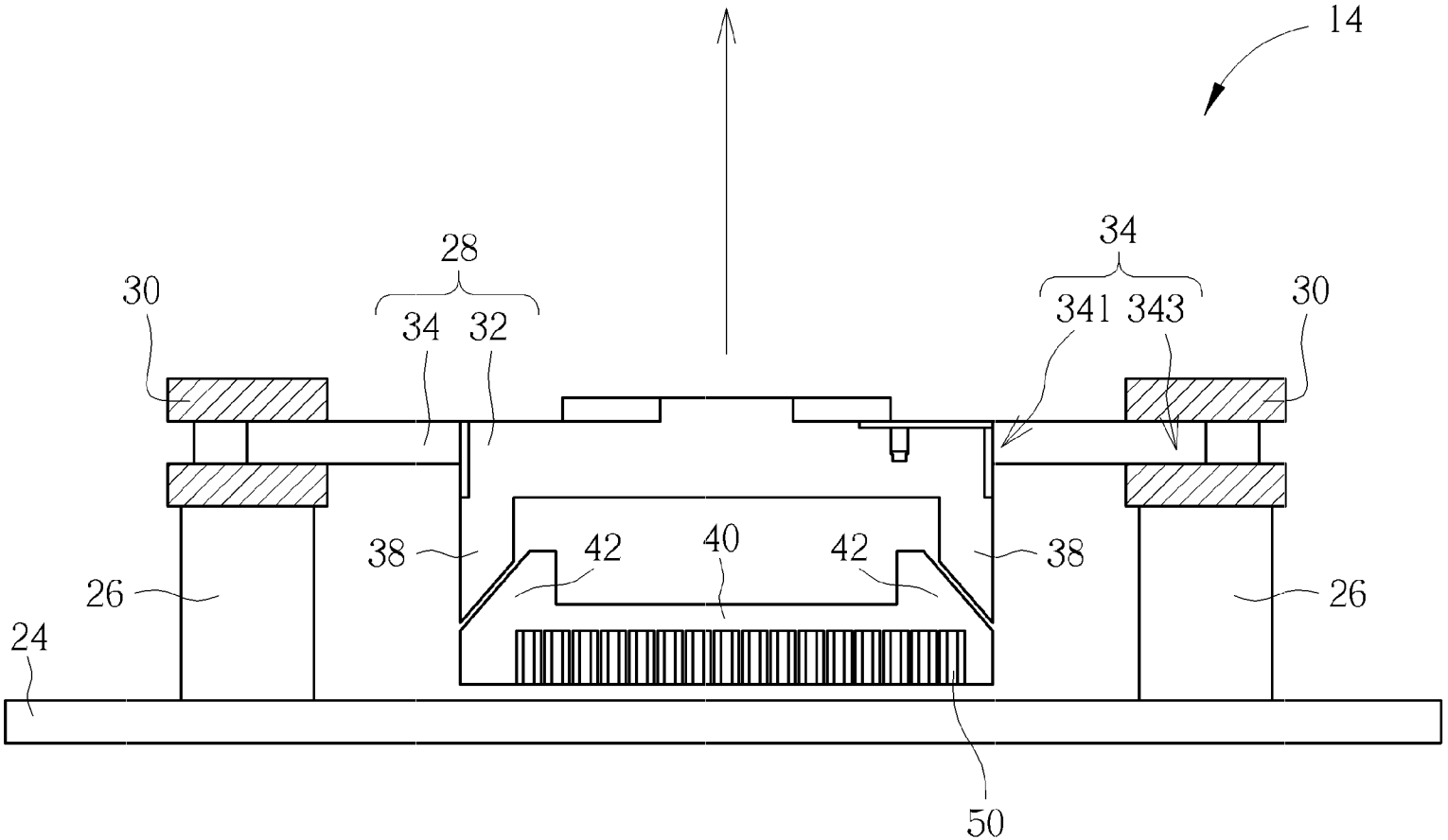
FIG. 4 to FIG. 6 respectively are diagrams of the speaker module in different operational modes according to the first embodiment of the invention.
Figure 5:
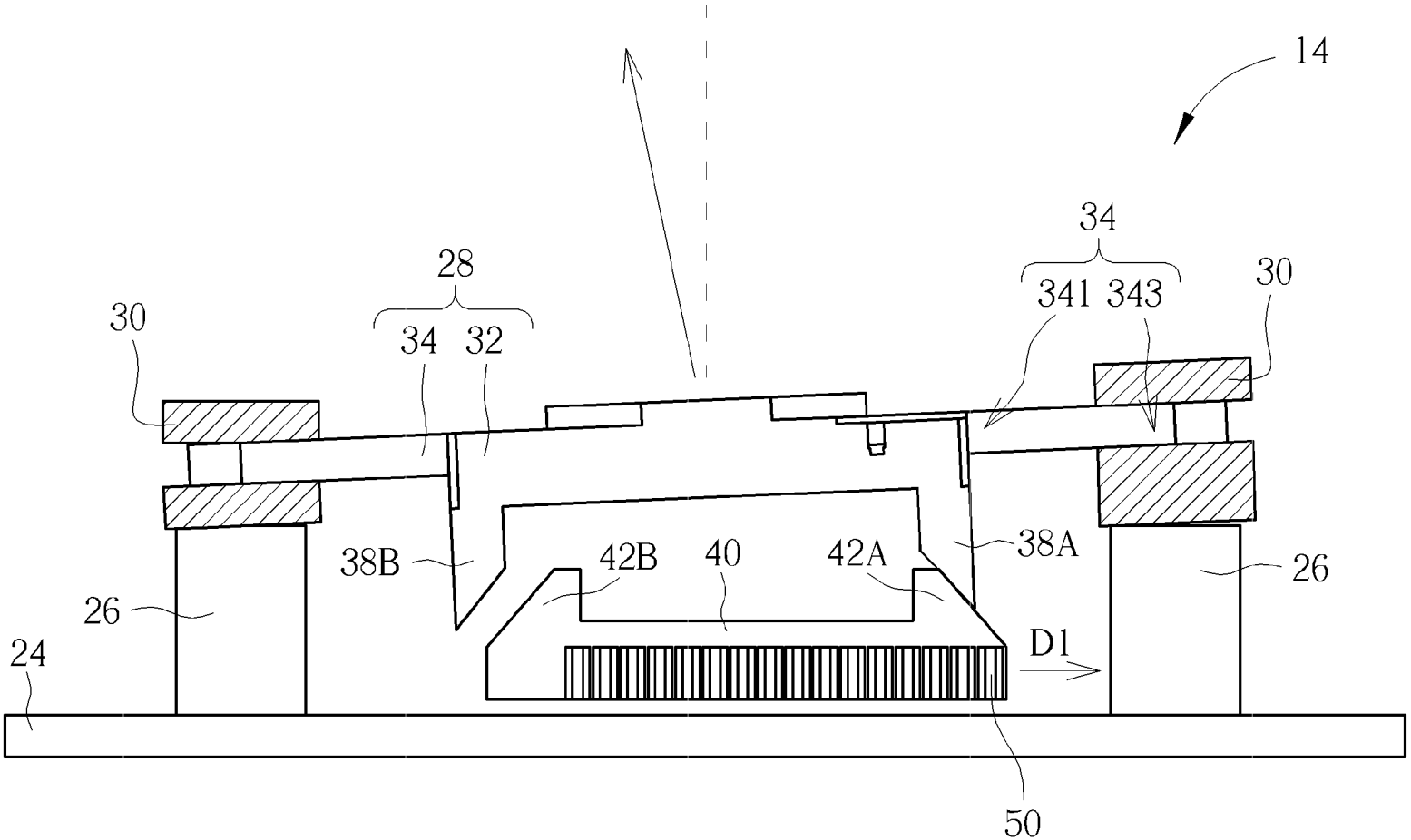
Figure 6:
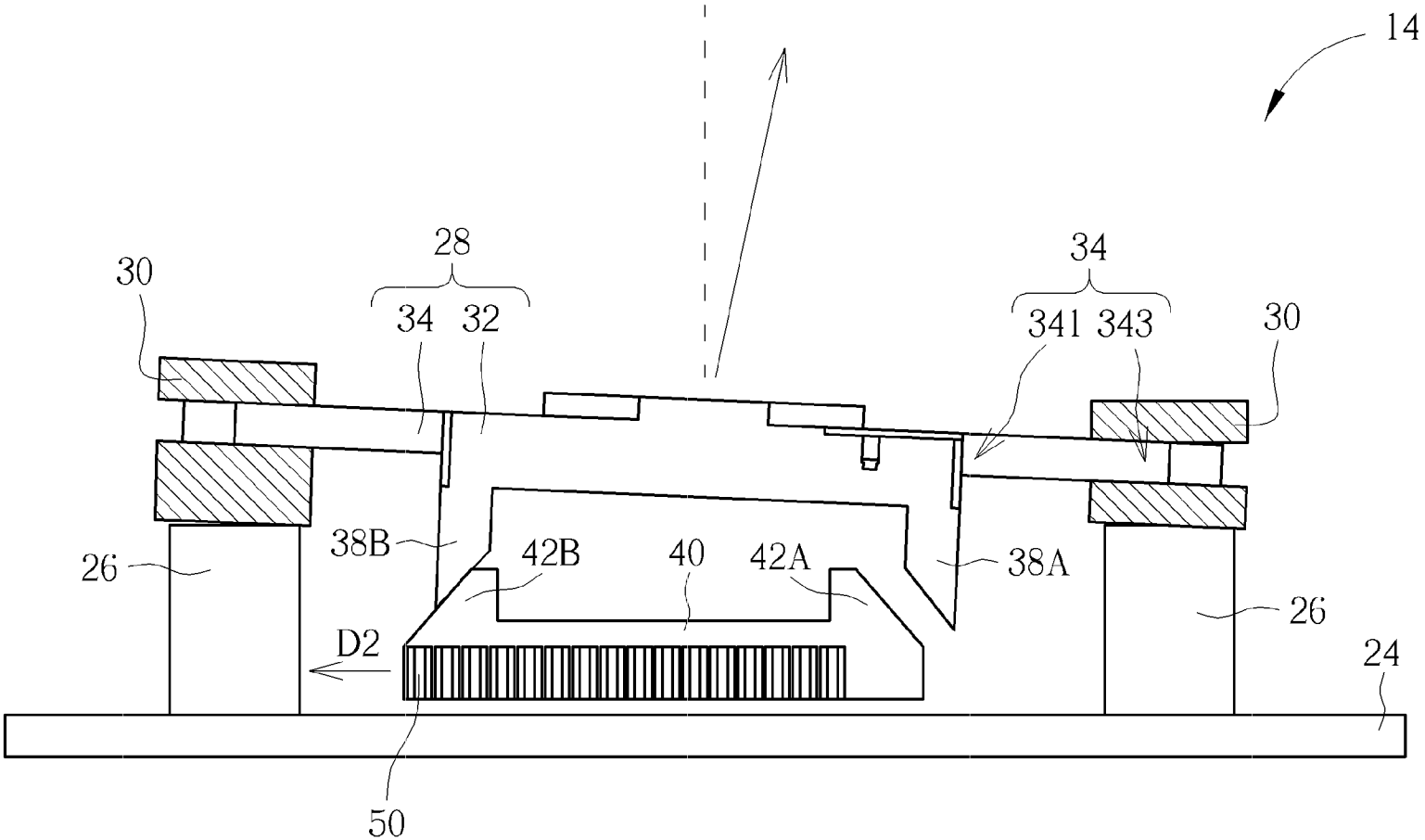

Please refer to FIG. 3 to FIG. 6. FIG. 4 to FIG. 6 respectively are diagrams of the speaker module 14 in different operational modes according to the first embodiment of the invention. As shown in FIG. 4, the body 40 of the lifting mechanism 36 is placed between the two supporters 42. The speaker 28 can be substantially parallel to the base 24. The sound generated by the speaker unit 32 is transmitted along an arrow in FIG. 4. As shown in FIG. 5, the controller 46 can rotate the gear 52 at a clockwise direction R1 (as shown in FIG. 3) for adjusting the outputting direction of the sound to the left side. The gear 52 moves the body 40 at a first direction D1 via the rack 50. Meanwhile, the second lifting component 42A disposed on the right of the body 40 can slide relative to the first lifting component 38A disposed on the right of the speaker unit 32, and the second lifting component 42B disposed on the left of the body 40 can move away from the first lifting component 38B disposed on the left of the speaker unit 32. The right of the speaker 28 is risen, and the left of the speaker 28 is descended. The speaker 28 can tilt toward the left side, and the sound is transmitted along an arrow in FIG. 5.

Furthermore, as shown in FIG. 6, the controller 46 can rotate the gear at a counterclockwise direction R2 (as shown in FIG. 3) for adjusting the outputting direction of the sound to the right side. The gear 52 can slide the body 40 at a second direction D2 opposite to the first direction D1 via the rack 50. Therefore, the second lifting component 42A moves away from the first lifting component 38A, the second lifting component 42B slides relative to the first lifting component 38B. The left of the speaker 28 is risen, and the right of the speaker 28 is descended. The speaker 28 can tilt toward the right side, and the sound is transmitted along an arrow in FIG. 6.

Figure 7:
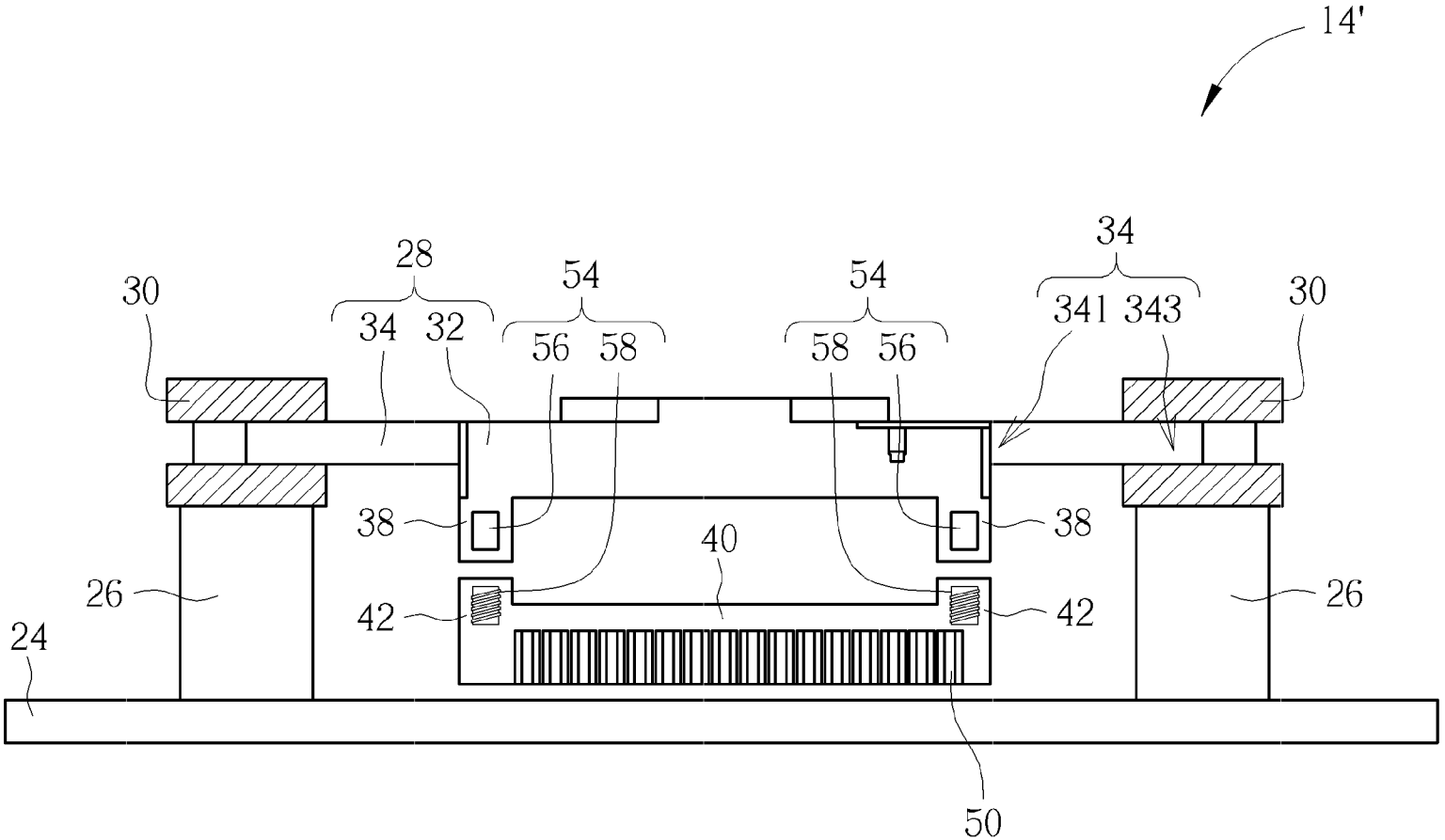
FIG. 7 is a diagram of the speaker module according to the second embodiment of the invention.

Please refer to FIG. 7. FIG. 7 is a diagram of the speaker module 14' according to the second embodiment of the invention. The speaker module 14' utilizes the electromagnetic skill to drive the lifting mechanism 36. For example, the first lifting component 38 and the second lifting component 42 can respectively be electromagnetic components. The second lifting component 42 can control variation of magnetic flux by varying the current or the voltage, so as to adjust values of magnetic attractive force or magnetic repulsive force for moving the first lifting component 38. The height of the first lifting component 38 is adjustable. The speaker module 14' includes the base 24, the supporters 26, the speaker 28, the resilient washers 30 and the lifting mechanism 36, which are the same as the first embodiment. Difference between the first embodiment and the second embodiment is that the electromagnetic force is applied to adjust the relative movement between the first lifting component 38 and the second lifting component 42. The lifting mechanism 36 of the second embodiment can includes two electromagnetic drivers 54 respectively disposed between the corresponding lifting components. The electromagnetic drivers 54 utilize the electromagnetic force to adjust the height of the first lifting component 38 relative to the second lifting component 42.

As shown in FIG. 7, the electromagnetic driver 54 can include a magnetic element 56 and an electromagnetic element 58. The magnetic element 56 is disposed on the first lifting component 38. The electromagnetic element 58 is disposed on the second lifting component 42 and adjacent to the magnetic element 56. For adjusting the rotary angle of the speaker unit 32, the controller 46 can output a command to vary the magnetic flux of the electromagnetic element 58, so as to adjust the value of the magnetic force (the magnetic attractive force or the magnetic repulsive force) for moving the magnetic element 56 relative to the electromagnetic element 58. Therefore, the relative height between the first lifting component 38 and the second lifting component 42 can be varied to tilt the speaker 28 toward the left side and the right side. Motion of the speaker 28, the first lifting component 38 and the second lifting component 42 is the same as ones of the first embodiment, and detailed description is omitted herein for simplicity.

In conclusion, the present invention movably disposes the speaker on the supporters, and utilizes the lifting mechanism to push two sides of the speaker for adjusting the outputting direction of the sound. In addition, the lifting mechanism of the present invention can use the mechanical driver or the electromagnetic driver. As the mechanical driver is applied, the engagement and the rotation of the rack and the gear can move the body, and the inclined structures (the first lifting component and the second lifting component) can slide to each other for adjusting the distance (or the height) between the lifting components.

As the electromagnetic driver is applied, the magnetic flux of the electromagnetic element is varied by the controller. The magnetic force generated by the variation of the magnetic flux can increase and decrease the distance (or the height) between the lifting components. Because the lifting components are disposed on lateral sides of the speaker, the speaker unit can shake by the lifting mechanism, so as to accurately adjust the outputting direction of the sound generated by the speaker unit. The controller can further rotate the speaker modules to the suitable rotary angle according to the detection (position of the external object) of the sensor, and then the user can feel preferable sound quality. For example, the rotary angle of each speaker module can be 30 degrees relative to the external object.

Comparing to the prior art, the speaker module of the present invention can adjust the rotary angle of the speaker unit. The present invention further can detect the position of the user, rotate the speaker modules toward the user according to the detection for preferred sound filed. Thus, the sound generated by the speaker modules can be combined with each other, to form the sound waves with huge amplitude, so as to simulate the stereo sound and to enhance effect of the low-frequency sound. The rotary speaker module is disposed inside the casing, so that the electronic device of the present invention can conform to the concise appearance. The lifting mechanism of the present invention not only has advantages of simple structure, easy operation and low manufacturing cost, but also has small volume. The small size lifting mechanism can be easily disposed inside the accommodating structure of the casing with the speaker, and the electronic device performs the concise appearance.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A speaker module comprising:
- a base;
- a supporter disposed on the base;
- a speaker, the speaker comprising:
  - a speaker unit disposed above the base, the speaker unit generating a sound; and
  - an arm, a first end of the arm being connected to a lateral side of the speaker unit, a second end of the arm different from the first end being movably disposed on the supporter;
- a lifting mechanism, the lift mechanism comprising:
  - a first lifting component disposed on the speaker unit;
  - a body disposed on the base; and
  - a second lifting component disposed on the body and adjacent to the first lifting component, the second lifting component adjusting a height of the first lifting component, so as to rotate the speaker unit relative to the supporter via the arm;
- a sensor for detecting a position of an external object; and
- a controller electrically connected to the sensor and the lifting mechanism, the controller being adapted to drive the second lifting component to adjust the height of the first lifting component according to detection of the sensor, so as to control a rotary angle of the speaker unit.

2. The speaker module of claim 1, wherein the first lifting component and the second lifting component respectively are inclined structures, the body is slidably disposed on the base, the second lifting component slides relative to the first lifting component with a movement of the body, so as to adjust the height of the first lifting component.

3. The speaker module of claim 2, wherein the lifting mechanism further comprises:
- a mechanical driver for sliding the second lifting component relative to the first lifting component, the mechanical driver comprising:
  - a rack disposed on the body; and
  - a gear disposed on the base and engaged with the rack, the gear being revolved on a shaft to move the body relative to the base via the rack, so that the second lifting component slides relative to the first lifting component.

4. The speaker module of claim 1, wherein the first lifting component and the second lifting component respectively are electromagnetic components, the second lifting component utilizes magnetic force to adjust the height of the first lifting component.

5. The speaker module of claim 4, wherein the lifting mechanism further comprises:
- a electromagnetic driver for adjusting the height of the first lifting component relative to the second lifting component, the electromagnetic driver comprising:
  - a magnetic element disposed on the first lifting component; and
  - an electromagnetic element disposed on the second lifting component, the magnetic force being generated between the magnetic element and the electromagnetic element by variation of magnetic flux.

6. The speaker module of claim 1, further comprising:
- a resilient washer disposed on the supporter, the arm being movably disposed on the supporter via the resilient washer.

7. The speaker module of claim 1, wherein the speaker module further comprises two supporters, the speaker further comprises two arms respectively disposed on two opposite sides of the speaker unit, each arm is movably disposed on the corresponding supporter, the lifting mechanism further comprises two first lifting components and two second lifting components respectively disposed on two opposite sides of the speaker unit and the body, the lifting mechanism adjusts the height of each first lifting component relative to the corresponding second lifting component to vary a rotary angle of the speaker unit.

8. An electronic device comprising:
- a casing, the casing comprising an accommodating structure and a plank, at least one hole being formed on the plank, the plank covering the accommodating structure; and
- at least one speaker module disposed inside the accommodating structure, a sound outputted from the speaker module passing through the hole on the plank to be out of the accommodating structure, the speaker module comprising:
  - a base;
  - a supporter disposed on the base;
  - a speaker, the speaker comprising:
    - a speaker unit disposed above the base, the speaker unit generating the sound; and an arm, a first end of the arm being connected to a lateral side of the speaker unit, a second end of the arm different from the first end being movably disposed on the supporter;

a lifting mechanism, the lift mechanism comprising:

a first lifting component disposed on the speaker unit;

a body disposed on the base; and a second lifting component disposed on the body and adjacent to the first lifting component, the second lifting component adjusting a height of the first lifting component, so as to rotate the speaker unit relative to the supporter via the arm;

a sensor for detecting a position of an external object; and a controller electrically connected to the sensor and the lifting mechanism, the controller being adapted to drive the second lifting component to adjust the height of the first lifting component according to detection of the sensor, so as to control a rotary angle of the speaker unit.

9. The electronic device of claim 8, wherein the first lifting component and the second lifting component respectively are inclined structures, the body is slidably disposed on the base, the second lifting component slides relative to the first lifting component with a movement of the body, so as to adjust the height of the first lifting component.

10. The electronic device of claim 9, wherein the lifting mechanism further comprises:

a mechanical driver for sliding the second lifting component relative to the first lifting component, the mechanical driver comprising:

a rack disposed on the body; and a gear disposed on the base and engaged with the rack, the gear being revolved on a shaft to move the body relative to the base via the rack, so that the second lifting component slides relative to the first lifting component.

11. The electronic device of claim 8, wherein the first lifting component and the second lifting component respectively are electromagnetic components, the second lifting component utilizes magnetic force to adjust the height of the first lifting component.

12. The electronic device of claim 11, wherein the lifting mechanism further comprises:

a electromagnetic driver for adjusting the height of the first lifting component relative to the second lifting component, the electromagnetic driver comprising:

a magnetic element disposed on the first lifting component; and an electromagnetic element disposed on the second lifting component, the magnetic force being generated between the magnetic element and the electromagnetic element by variation of magnetic flux.

13. The electronic device of claim 8, wherein the speaker module further comprises:

a resilient washer disposed on the supporter, the arm being movably disposed on the supporter via the resilient washer.

14. The electronic device of claim 8, wherein the speaker module further comprises two supporters, the speaker further comprises two arms respectively disposed on two opposite sides of the speaker unit, each arm is movably disposed on the corresponding supporter, the lifting mechanism further comprises two first lifting components and two second lifting components respectively disposed on two opposite sides of the speaker unit and the body, the lifting mechanism adjusts the height of each first lifting component relative to the corresponding second lifting component to vary a rotary angle of the speaker unit.

15. The electronic device of claim 8, wherein the electronic device comprises two speaker modules respectively on two opposite sides of the casing, the controller rotates each speaker module at an angle pointing toward the external object according to the detection.

* * * * *